United States Patent [19]

Yarnitsky et al.

[11] 4,433,794

[45] Feb. 28, 1984

[54] JIG FOR MACHINING STYLUS BLANKS

[75] Inventors: Yashaya Yarnitsky; Shmuel Kaldor, both of Haifa, Israel

[73] Assignee: RCA Corporation, New York, N.Y.

[21] Appl. No.: 285,620

[22] Filed: Jul. 21, 1981

[51] Int. Cl.[3] ..... B65G 61/00

[52] U.S. Cl. ..... 221/224; 221/232; 221/238; 221/267; 227/130; 81/57.37; 269/254 R

[58] Field of Search ..... 221/191, 210, 219, 220, 221/234, 232, 267, 288, 310, 276, 224, 225, 226, 236, 238, 195, 66, 255; 81/57.37, 452; 227/130; 414/131, 751; 269/254, 287; 279/28, 29, 35, 51

[56] References Cited

U.S. PATENT DOCUMENTS

| | | | |
|---|---|---|---|
| 1,815,594 | 7/1931 | Shaw et al. | 81/57.37 |
| 3,019,027 | 1/1962 | Klein et al. | 279/30 |
| 3,888,404 | 6/1975 | Ramspeck et al. | 227/130 |
| 3,907,014 | 9/1975 | Manino | 81/57.37 |
| 3,975,032 | 8/1976 | Bent et al. | 279/30 |

*Primary Examiner*—Joseph J. Rolla
*Assistant Examiner*—Lawrence J. Miller
*Attorney, Agent, or Firm*—Birgit E. Morris; Donald S. Cohen; Thomas H. Magee

[57] ABSTRACT

A jig comprises a housing which contains a storage channel and a feed channel. The feed channel communicates with the storage channel and extends to the front end of the housing. The jig also has a releasable gripping portion located at its front end. The releasable gripping portion grips and releases stylus blanks. The jig also has bolt for transporting blanks from the storage channel through the feed channel to the releasable gripping portion.

11 Claims, 6 Drawing Figures

JIG FOR MACHINING STYLUS BLANKS

BACKGROUND OF THE INVENTION

1. Field of the Invention

This invention pertains to a jig which is designed to hold a blank in a fixed position during machining operations such as lapping. More particularly, this invention pertains to a jig which will automatically feed a single stylus blank from a stack of stylus blanks, hold the single blank in a fixed position during machining, eject a machined stylus, and hold a subsequent stylus blank in a fixed position for a subsequent machining operation.

2. Description of the Prior Art

It is known to use a stylus such as that disclosed in U.S. Pat. No. 4,162,510 issued to E. O. Keizer on July 24, 1979 and assigned to RCA Corporation to read signals from grooves which are cut into an information record such as a plastic disc. A blank made of a relatively hard material (such as diamond) is used to manufacture the stylus. The blank is lapped along certain crystal planes to take advantage of properties exhibited by the surfaces along these planes. It is necessary to hold the blank in a fixed position during lapping in order to insure lapping accuracy.

In the commonly-owned patent applications of Ziegel, Ser. No. 118,214, filed Feb. 4, 1980 and entitled "WORK HOLDER", and of Manson, Ser. No. 172,758, filed July 28, 1980 and entitled "STONE-POSITIONING APPARATUS AND METHOD", devices are disclosed which can hold an individual stylus blank in a fixed position during lapping. In both of these devices, individual stylus blanks are manually introduced into a jig and are manually withdrawn therefrom. Since the stylus blanks are relatively small and each one must be handled manually, manufacture of styli from stylus blanks using these devices is a labor-intensive and time-consuming process.

It would therefore be advantageous to provide a jig which would be able to store a plurality of stylus blanks, hold individual stylus blanks in a fixed position for accurate lapping, and enable a finished stylus to be ejected and replaced by another stylus blank automatically, without requiring manual handling of individual stylus blanks.

SUMMARY OF THE INVENTION

A jig comprises a housing which has a front end, a feed channel, and a storage channel. The feed channel extends to the front end of the housing and the storage channel communicates with the feed channel. The jig also has a releasable gripping means which is located at the front end of the housing and which grips and releases blanks that are transported to it. The jig further has means for transporting individual blanks from the storage channel through the feed channel to the releasable gripping means. Thus, when a stack of blanks is stored in the storage channel, single blanks will be individually transported to the releasable gripping means, held fixed therein during machining, and ejected therefrom after machining is finished, permitting the next blank to be held fixed therein and this sequence to be repeated once again.

DETAILED DESCRIPTION OF THE PREFERRED EMBODIMENT

Figure 2:
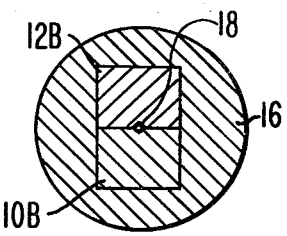
FIG. 2 is a cross-sectional view of the jig, taken along line 2—2 of FIG. 1.
Figure 1:
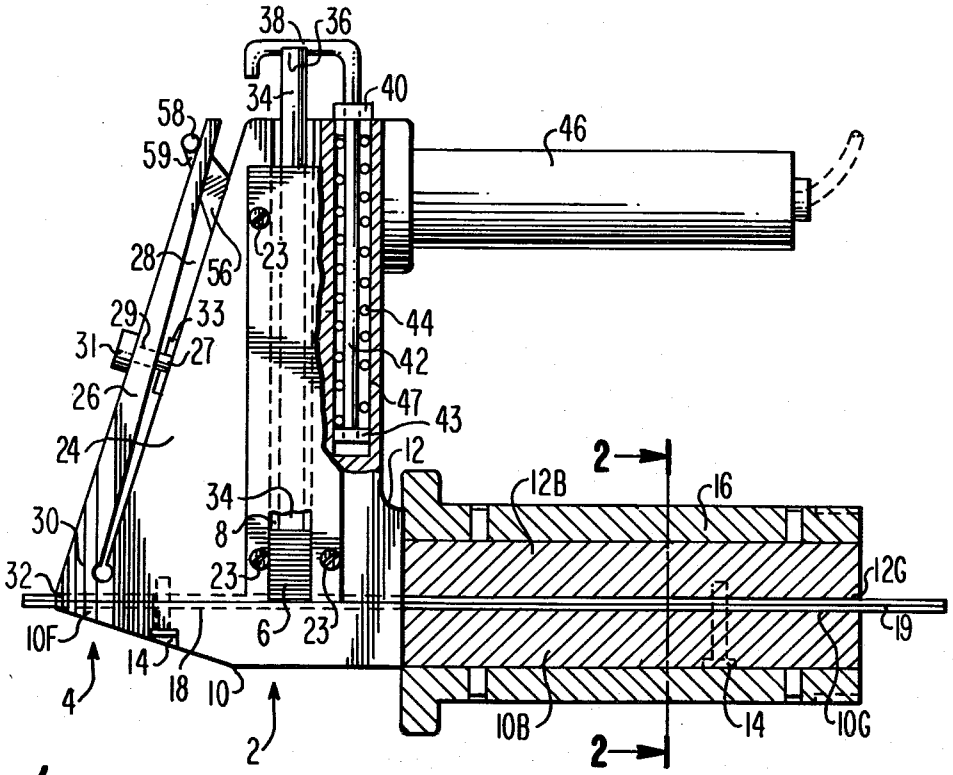
FIG. 1 is a left side view, partially in cross-section, of a jig which incorporates this invention.

In FIG. 1, a housing, generally indicated by reference numeral 2, has a front end 4 and is formed by a lower section 10 and an upper section 12. The lower section 10 is horizontally elongated and chisel-shaped, having a constant thickness at its back end 10B and having a thickness decreasing towards its nearly point-like front end 10F. Upper section 12 is generally L-shaped, and is secured to lower section 10 by screws 14 so that the horizontal part of the L mates with the lower section 10. The screws 14 are recessed into the lower section 10 and are threaded into tapped holes in the upper section 12. A cylindrical collar 16 surrounds the back ends 10B and 12B of the lower section 10 and the upper section 12 to keep the back ends 10B and 12B aligned. A feed channel 18 is formed between the lower section 10 and the upper section 12 by like mating grooves 10G and 12G, each groove 10G and 12G being formed in a corresponding one of the sections 10 and 12, and both grooves 10G and 12G mating together to yield a horizontally elongated feed channel 18 having a diamond-shaped cross-section, as shown in FIG. 2. The groove 12G is shallower at the front of the upper section 12, for reasons which will be explained later.

Figure 5:
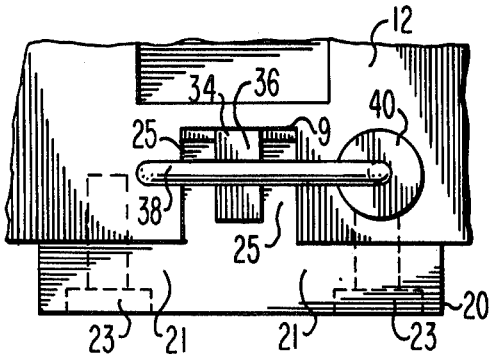
FIG. 5 is a top detail view of the construction of the storage channel of the jig.

The construction of the upper section 12 and the elements associated therewith, are illustrated in FIGS. 1 and 5. It can be seen that a channel 8 is defined between a vertically elongated and rectangular open-faced notch 9, which is cut into the left side of upper section 12 between the front end 4 and the collar 16, and a closure 20. The closure 20 has two flat flanges 21, through which four screws 23 extend. The screws 23 are threaded into tapped holes in the left side of upper section 12, securing the closure 20 and the upper section 12 together. The closure 20 further has two parallel fingers 25 which extend to the right. The fingers 25 reach almost to the bottom of the notch 9, so that the distance between the innermost ends of the fingers 25 and the bottom of the notch 9 is equal to the width of one blank. Thus, the storage channel 8 is bounded by the notch 9 and the fingers 25.

The storage channel 8 contains a stack 6 of blanks. All of the blanks in the stack 6 may or may not be detachably secured to each other by, e.g., a light adhesive. A vertically elongated rectangular bar 34 slides between the fingers 25, the bottom of the notch 9, and the closure 20. The bar 34 pushes the stack 6 down within the storage channel 8, when the bar 34 is itself pressed downwardly by a loading means, described immediately below and shown in FIG. 1.

The bar 34 is notched at its top end 36. The top end 36 is engaged by a horizontal arm 38. The arm 38 is attached to a vertical shank 42. An annular slip collar 40 surrounds the shank 42. The slip collar 40 is attached to the top of the upper section 12, and is abutted by the top end of a compression spring 44, the latter being wound around the shank 42. The compression spring 44 and the shank 42 are located within a vertical cylindrical well 47, which is located in the upper section 12, behing and parallel to the storage channel 8. A piston 43 is attached to the lower end of the shank 42. The lower end of the compression spring 44 abuts the piston 43, so that the arm 38 is urged downwardly by the compression spring 44, as the shank 42 moves downwardly through the slip collar 40. As the arm 38 is urged downwardly, it causes the bar 34 to bear against the stack 6. This urges the lowermost blank in the stack 6 downwardly towards the feed channel 18.

The storage channel 8 communicates with the feed channel 18 rearwardly of the front end 4 and forwardly of the collar 16. An elongated bolt 19 is slidably received within the feed channel 18. When the storage channel 8 accommodates the stack 6, only a lowermost blank in the stack 6 will be urged into the feed channel 18, since the feed channel 18 is so shaped that only one such blank may be accommodated therein at one time. When the bolt 19 is withdrawn so that its forwardmost end is behind the storage channel 8, the bolt 19 may then be advanced within the feed channel 18 to push a blank forward within the feed channel 18 and thereby transport the blank towards the front end 4. The bolt 19 is thus a means for transporting individual blanks from the storage channel 8 through the feed channel 18 to the releasable gripping means described below.

At the front end 4, the upper section 12 is divided into a fixed region 24 and a movable region 26 by a slot 28, which extends downwardly and forwardly from the top of upper section 12 almost to its bottom. The fixed region 24 and the movable region 26 are chisel-shaped and are thus transversely narrowest (as viewed in FIG. 4) at their lowest ends, e.g., at a deformable shoulder region 30. The lower end of the slot 28 is enlarged to form a transversely extending cylinder. Thus, the upper section 12 is unitary, with its fixed region 24 and its movable region 26 connected together at its deformable shoulder region 30.

A releasable gripping means has a first jaw formed by the front end 10F and a second jaw formed by the deformable shoulder region 30. These first and second jaws are aligned with each other to form a vise. When the movable region 26 is not subjected to pressure, the deformable shoulder region 30 will be in its maximally undeformed state, and the first and second jaws will be biased towards each other. Since the groove 12G is shallowest beneath the deformable shoulder region 30, this bias will exert pressure upon any blank or finished stylus which may be held in the releasable gripping means. However, if the movable region 26 is moved towards the fixed region 24, a forwardmost tip 32 of the deformable shoulder region 30 will be lifted upwardly and away from the front end 10F, thereby releasing any finished stylus which may be located between the first and second jaws of the releasable gripping means.

In order to slightly deform the deformable shoulder region 30, a stud 27 is affixed to the upper section 12 and protrudes through a hole 29 in the movable region 26. A knurled cap 31 is threaded onto the top the of stud 27 so that the knurled cap 31 lies flush upon and bears against the movable region 26. By threading the knurled cap 31 tightly against the movable region 26 (i.e., by biasing the movable region 26 towards greater deformation of the deformable shoulder region 30), the deformable region 30 is prevented from reaching the clamping yield point when in the maximally undeformed state. For this same reason, but to prevent yielding in the opposite direction, a washer 33 is utilized.

Figure 4:
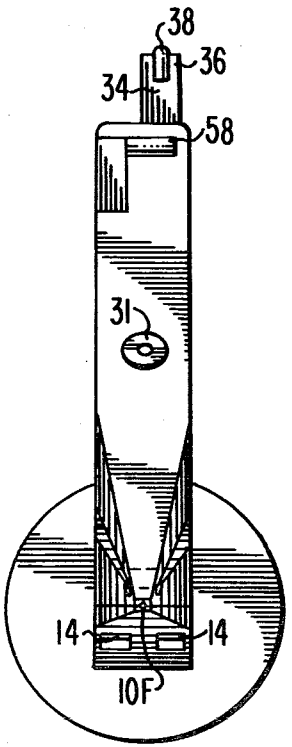
FIG. 4 is a front view of the jig.
Figure 3:
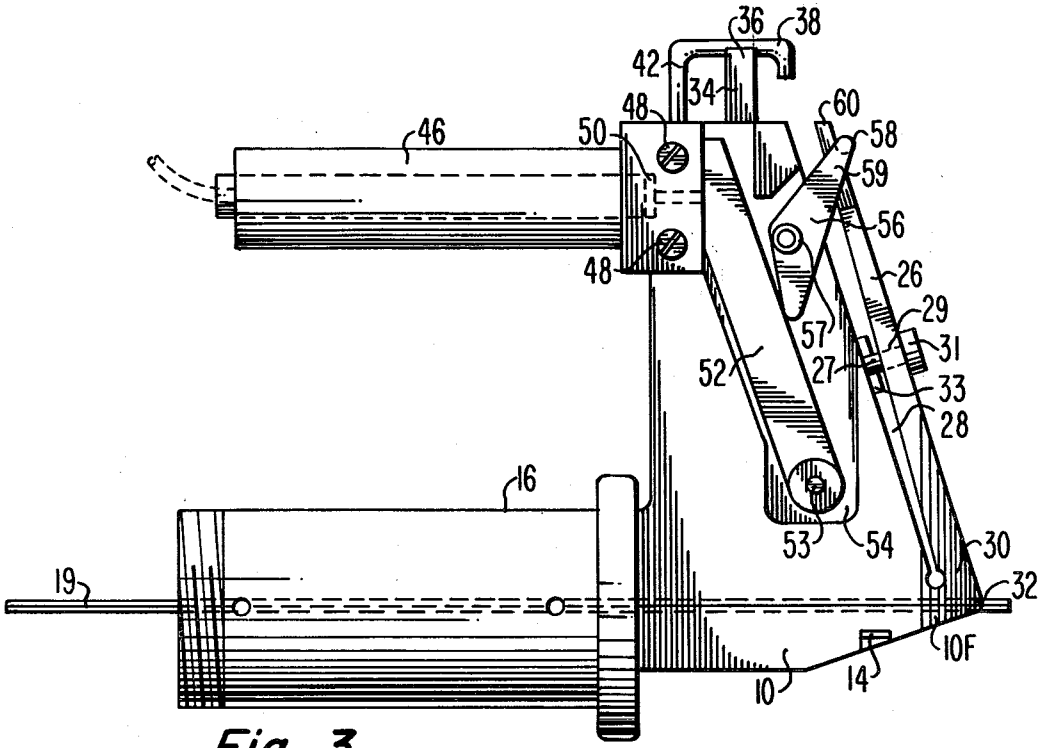
FIG. 3 is a right side view of the jig.
Figure 6:
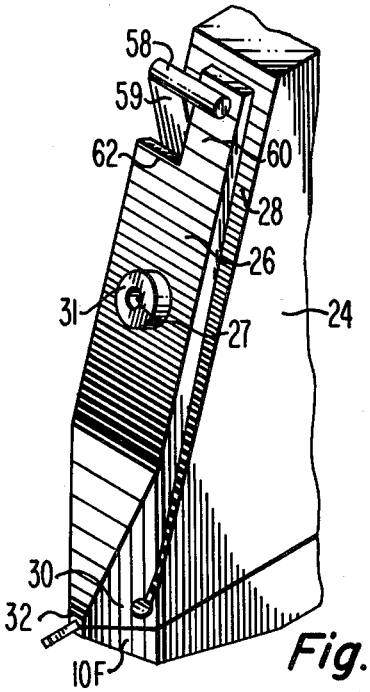
FIG. 6 is a perspective view showing the structure of a part of the releasable gripping means.

The movable region 26 is moved by a mechanical linkage which is illustrated in FIGS. 3, 4, and 6. FIG. 3 shows a solenoid 46, or another electronic actuator, located above and parallel to the collar 16. Solenoid 46 is attached to the upper section 12 by two screws 48. A plunger 50 is located at the forwardmost tip of the solenoid 46 and is moved forwardly and rearwardly depending upon energization of the solenoid 46.

The plunger 50 bears against the top end of a pivot arm 52. The bottom end of the pivot arm 52 is pivotally secured to the right side of the upper section 12 by a pivot 53. The pivot arm 52, as shown in FIG. 3, extends upwardly and rearwardly, and is recessed into a recess 54. The recess 54 is on the right side of the upper section 12, opposite the closure 20.

A generally triangular pivot plate 56 is similarly pivotally secured to the right side of the upper section 12 by a pivot 57 and is similarly recessed in the recess 54. The lowermost corner of the pivot plate 56 touches the pivot arm 52 near the middle of the latter element, so that the pivot plate 56 and the pivot arm 52 bear against each other and pivot together in opposite directions. The uppermost and forwardmost corner of the plate 56 supports a pin 58. The pin 58 extends transversely to the feed channel 18, and abuts the forward surface of the top end 60 of the movable region 26. To permit the pivot arm 52 and the pivot plate 56 to occupy and to pivot within a common plane flush with the right side of the upper section 12, the top end 60 has a notch 62 on the right, through which a region 59 of the pivot plate 52 can protrude. Since the upper section 12 always tends to assume its undeformed state, the movable region 26 tends to separate from the fixed region 24. This tends to pivot the pivot plate 56 in a clockwise sense, as viewed in FIG. 3, and thus causes the pivot arm 52 to pivot counterclockwise, as viewed in FIG. 3. This causes the plunger 50 to be pushed into the solenoid 46.

Let it be assumed that a stack 6 is placed within the storage channel 8, that the arm 36 is engaged with the bar 34, and that the bolt 19 is retracted so that its forwardmost end is located behind the storage channel 8. Let it further be assumed that movable region 26 is in its maximally undeformed state.

When the first blank in the stack 6 is to be lapped, the solenoid 46 is so energized that the plunger 50 is moved forwardly and held in its forward position. The pivot arm 52 is thus pivoted clockwise, causing the pivot plate 52 to pivot counterclockwise and to move the movable region 26 towards the fixed region 24, opening the releasable gripping means to receive the first blank.

Simultaneously, the bolt 19 is moved forward within the feed channel 18. Since the first (i.e., lowest) blank in the stack 6 has been pushed into the feed channel 18, this first blank is now pushed forward towards the releasable gripping means as the bolt 19 is advanced. Further introduction of blanks into the feed channel 18 is blocked by the presence of the bolt 19 beneath the storage channel 8.

After the first blank has been transported to the releasable gripping means with the front end of the blank protruding therefrom, the solenoid 46 is so energized that the plunger 50 can move rearwardly. As the upper section 12 tends to assume its undeformed state, the movable region 26 separates from the fixed region 24, causing the pivot plate 56 to pivot clockwise, which in turn causes the pivot arm 52 to pivot counterclockwise, thereby causing the plunger 50 to be pushed into the solenoid 46. This closes the releasable gripping means, fixing the first blank in position. The first blank may then be lapped at its protruding front end, and the bolt 19 may be retracted past the storage channel 8, allowing the second blank in the storage channel 8 to enter the feed channel 18.

After the first blank has been lapped into a finished stylus, this sequence may be repeated once again. The second blank will eject the finished stylus when the releasable gripping means is opened and the second blank is pushed forward by the bolt 19. As each blank is lapped into a finished stylus, the sequence is repeated until the storage channel 8 is emptied. The motion of the bolt 19 may be coordinated with the opening and closing of the releasable gripping means by driving the bolt 19 with, e.g., another electronic actuator (not shown) and utilizing electronic circuitry (also not shown) to coordinate the motion of the bolt 19 with energization of the solenoid 46. For example, the housing 2 may be connected to a sliding table (not shown) by means of the cylindrical collar 16, which is able to rotate within a supporting frame attached to the table. This would permit a turning movement around the axis of the stylus blank in order to form facets in any desired angular position by machining. The sliding table would allow the housing 2 to be pushed toward the lapping area and back. After one blank is lapped, the housing 2 moves back and, while moving, the solenoid 46 opens by means of a microswitch. Meanwhile, a new blank is being pushed from the feed channel 18 towards the front end 4 of the housing 2 by the bolt 19, which is connected to the lower part of the sliding table which does not move. The housing 2, continuing its movement back, urges the lapped blank out from the releasable gripping means by the new blank being pushed by the bolt 19. At this instant, the front end 4 of the housing 2 has been moved back enough to allow the lapped blank to fall onto a tray (not shown) mounted under the front end 4 of the housing 2 in its proper position. The housing 2 moves back enough to allow the bolt 19 to reach its deepest position (ensured by a pressure spring). This will always keep the overhang of the front of the new blank at the correct length.

What is claimed is:

1. A jig for use in machining blanks comprising:

a housing having a front end, a feed channel, and a storage channel, said feed channel extending to the front end and said storage channel communicating with the feed channel;

a releasable gripping means located at the front end of said housing for gripping and releasing blanks transported to said releasable gripping means, said releasable gripping means including a deformable region of the housing integrally formed adjacent the front end thereof, wherein a section of the housing forms a fixed first jaw and the deformable region forms a movable second jaw, the first and second jaws being aligned with each other to form a vise; and means disposed partly within said housing for transporting individual blanks from the storage channel through the feed channel to the releasable gripping means.

2. The jig defined by claim 1, further including a loading means disposed partly within said storage channel for urging the stack of blanks towards the feed channel.

3. The jig defined by claim 1, wherein said feed channel is shaped in a manner such that only one blank from the storage channel may be introduced into the feed channel at one time.

4. The jig defined by claim 3, wherein said transporting means comprises an elongated bolt slidably received within the feed channel and adapted for moving blanks therein by pushing them forward towards the releasable gripping means.

5. The jig defined by claim 1, wherein the deformable region is a part of a unitary slotted housing section.

6. The jig defined in claim 5, wherein the deformable region is biased to grip a blank when the deformable region is slightly deformed.

7. The jig defined by claim 6, wherein the unitary slotted housing section further includes a movable region and a fixed region which are connected together by the deformable region.

8. The jig defined by claim 7, further including means for slightly deforming said deformable region, in order that the deformable region may be biased to grip a blank.

9. The jig defined by claim 8, wherein said means for slightly deforming includes a stud which is affixed to the fixed region and which extends through a hole in the movable region, and wherein said means for slightly deforming further includes a cap which is threaded onto the stud and which bears against the movable region.

10. The jig defined by claim 7, further including mechanical linkage which is attached to the fixed region and which moves the movable region towards the fixed region in a manner adapted to deform the deformable region.

11. The jig defined by claim 10, wherein the mechanical linkage includes:

a pivot plate which is pivotally secured to the fixed region and which supports a transversely extending pin that abuts the forward surface of the movable region; and a pivot arm which is pivotally secured to the fixed region and which bears against the pivot plate, in a configuration whereby the pivot plate and the pivot arm pivot together in opposite directions.

* * * * *